US008938849B2

(12) United States Patent
Cleary

(10) Patent No.: US 8,938,849 B2
(45) Date of Patent: Jan. 27, 2015

(54) VACUUM ASSEMBLY

(75) Inventor: Scott Andrew Cleary, Scaborough (AU)

(73) Assignee: Kit-Vac International Pty Ltd (AU)

( * ) Notice: Subject to any disclaimer, the term of this patent is extended or adjusted under 35 U.S.C. 154(b) by 19 days.

(21) Appl. No.: 13/824,997

(22) PCT Filed: Nov. 9, 2011

(86) PCT No.: PCT/AU2011/001444

§ 371 (c)(1),
(2), (4) Date: Mar. 18, 2013

(87) PCT Pub. No.: WO2012/061884

PCT Pub. Date: May 18, 2012

(65) Prior Publication Data

US 2013/0180078 A1 Jul. 18, 2013

(30) Foreign Application Priority Data

Nov. 10, 2010 (AU) ..... 2010904965

(51) Int. Cl.

| | |
|---|---|
| ***A47L 5/38*** | (2006.01) |
| ***A47L 7/00*** | (2006.01) |
| ***A47L 9/14*** | (2006.01) |
| ***A47L 9/28*** | (2006.01) |

(52) U.S. Cl.

CPC ..... *A47L 5/38* (2013.01); *A47L 7/0047* (2013.01); *A47L 9/14* (2013.01); *A47L 9/2842* (2013.01); *A47L 9/2857* (2013.01)

USPC ..... 15/301; 15/347

(58) Field of Classification Search

USPC ..... 15/301, 310, 319, 334, 327.2

See application file for complete search history.

(56) References Cited

U.S. PATENT DOCUMENTS

| | | | | |
|---|---|---|---|---|
| 3,027,587 | A * | 4/1962 | Bierstock | 15/301 |
| 3,593,363 | A * | 7/1971 | Hamrick | 15/315 |
| 3,655,927 | A | 4/1972 | Samuelson et al. | |
| 5,504,967 | A | 4/1996 | Graham | |
| 6,108,858 | A | 8/2000 | Smith | |
| 6,230,361 | B1 * | 5/2001 | Griffin | 15/310 |
| 6,292,977 | B1 | 9/2001 | Mantyla et al. | |
| 6,671,924 | B1 * | 1/2004 | Rood | 15/310 |
| 7,328,478 | B2 * | 2/2008 | Jenkins | 15/301 |
| 2010/0095475 | A1 * | 4/2010 | Gomes Melico et al. | 15/301 |
| 2012/0228536 | A1 * | 9/2012 | Parkinson | 251/321 |

FOREIGN PATENT DOCUMENTS

| | | | |
|---|---|---|---|
| AU | WO2012/061884 | A1 | 5/2012 |
| CA | 2239535 | A1 | 3/1999 |

* cited by examiner

*Primary Examiner* — Dung Van Nguyen
(74) *Attorney, Agent, or Firm* — Jill A. Jacobson

(57) ABSTRACT

A vacuum assembly comprising: (a) an inlet having an open and closed position; (b) a waste collection member (c) a vacuum means for generating a flow of air from said inlet to said collection member; and (d) a switch adapted to interact with the inlet, wherein the inlet when open activates the switch to receive debris through the inlet. The assembly is flush mounted to an existing fitting.

17 Claims, 7 Drawing Sheets

VACUUM ASSEMBLY

CROSS-REFERENCE TO RELATED APPLICATIONS

This application is a U.S. national stage application under 35 U.S.C. §371 of PCT/AU2011/001444, filed on Nov. 9, 2011 and published as WO2012/061884 A1 on May 18, 2012, which claims priority to Australian application no. 2010904965, filed on Nov. 10, 2010.

FIELD OF THE INVENTION

The invention relates to a vacuum assembly, particularly comprising an inlet such as a door which is flush mounted to an existing fitting to collect debris.

BACKGROUND OF THE INVENTION

Traditionally central vacuum systems have existed for a number of years now whereby the main machine is located in a remote area location (generally the garage or closet/mud room areas) and a pipe network is run throughout the house to provide a certain number of inlets in order to vacuum a building with the aid of hoses.

More recently, some smaller machines have come onto the market in a variety of shapes and sizes and which predominantly use existing fittings and central vacuum procedures to install and operate these machines and some have integrated fixed dust collectors at the floor level.

Cleaning of non-carpeted surfaces includes using a broom or a vacuum cleaner. Brooms are typically manipulated to sweep the dirt across the surface of a hard finish or non-carpeted floor to be swept into a shovel-shaped dustpan. This practice has always had the shortcoming of requiring some degree of care and dexterity in the manipulation of the dirt collected, particularly in the collection of light dust particles or animal hairs, which are easily distributed by relatively light air currents, such as those generated by the simple movement of the broom itself. Dustpans have typically been constructed of formed sheet metal or plastic configured with a forwardly opening flat bottom, wide scoop and a rearward projecting rigid handle. The manipulation of such device in turn typically requires a considerable degree of bending or stooping on behalf of the operator, an exercise that can be stressful, fatiguing and even painful to those with back problems. While modifications of such dustpans include long handles pivotally carrying the scoop, the operator still needs to concurrently manipulate a long handled broom and dustpan assembly in an effort to guide dirt into the scoop and transfer the dirt into a bin. These difficulties of the use of a broom and conventional dustpan arrangements have led to the design of vacuum cleaners, both of the upright type with a long handle and the horizontal type with long hoses and nozzles. Vacuum cleaning devices which have particular utility for cleaning such floor surfaces of dirt and dust with some degree of ease have certain drawbacks. The drawbacks include difficulties in having to maneuver the vacuum cleaner across a room and between rooms, hose fittings requiring large storage space, and the inconvenience of assembling the vacuum cleaner to clean or to remove small spillages on a regular basis in small areas such as the kitchen.

U.S. Pat. No. 6,292,977 discloses a vacuum fitting including an opening and a closing position activated by two separate means including an outwardly extending toe lift portion. The unit is not flush with the existing fittings as the toe lift portion extends outwardly.

U.S. Pat. No. 6,108,858 discloses a vacuum system comprising a floor mounted waste receptacle. This system includes an opening as an inlet to receive debris. The top portion of this system contains a switch which activates the vacuum system.

Both of the above units are not flush with the existing fittings. The system according to the latter patent particularly can be accidentally activated, resulting in damage to the vacuum system.

Furthermore, continuing innovation and new product advancements within the building industry has led to a greater requirement for aesthetic products that do not require a lot of space, are compact, non obtrusive, seamless and not seen by the eye (smooth lined and flush mounted products). Additionally, the new area of building designs incorporates open plan living, whereby the kitchen area has become part of the main living area. Hence, kickboard area that houses the kitchen cupboards and walkways can be visibly seen which has led to a large increase in choice of colours for even kickboard or architraves, which in itself has become a feature of a building to accommodate individual preferences.

Therefore there remains a need for a vacuum assembly that is convenient to use and is aesthetic.

SUMMARY OF THE INVENTION

The present invention provides a vacuum assembly comprising: (a) an inlet A having an open and closed position; (b) a waste collection member (c) a vacuum means for generating a flow of air from said inlet to said collection member; and (d) an electrical switch adapted to interact with the inlet, wherein the inlet when open activates the switch to allow/direct/receive waste/debris through the inlet.

Preferably, the inlet is opened by pushing the inlet inwardly by application of slight pressure.

Preferably, the pressure is applied by pushing or pressing a foot against the inlet.

Preferably, the switch operates in an OFF position when the door is closed and ON position when slight pressure is applied to the inlet.

In another aspect, the invention provides a vacuum waste collector comprising a plurality of open holes.

Preferably, the vacuum waste collector comprises two receiving holes.

Preferably, the collector is adapted to receive waste from a vacuum assembly.

Preferably, the receiving holes form in opposite ends of the same collector.

Preferably, one end is connected to a utility valve and the other end is connected to inlet A.

Preferably, the collector comprises material selected from fibre, cellulose, synthetic, paper, plastic, cloth etc Preferably, the two receiving holes form in different collectors.

In another aspect, the invention provides a vacuum assembly for collecting debris comprising: (a) an inlet having an open and closed position; (b) optionally a waste collection member (c) a vacuum means for generating a flow of air from said inlet to said collection member; and (d) an electrical switch adapted to interact with the inlet, wherein the inlet when open activates the switch to allow/direct/receive waste/debris through the inlet.

In another aspect, the invention provides a vacuum assembly for collecting debris comprising: (a) an inlet having an open and closed position; (b) a waste collection member (c) a vacuum means for generating a flow of air from said inlet to said collection member; and (d) an electrical switch adapted to interact with the inlet, wherein the inlet when open activates the switch to allow/direct/receive waste/debris through the inlet and wherein the waste collection member comprises a plurality of open ends.

Preferably, the inlet is flush mounted to an existing fitting.

Preferably, the inlet is flush mounted to a kitchen cabinet kickboard, bathroom or a laundry wall.

Preferably, the inlet is flush mounted to a breakfast bar.

Preferably, the inlet is wall mounted substantially perpendicular to a bench top.

Preferably, the same assembly is operable for both LHS and RHS mouth.

Preferably, the inlet comprises stainless steel, plastic or laminate material.

Preferably, the assembly further comprises an inlet valve adapted to receive a vacuum hose fitting.

In another aspect, the invention provides a vacuum assembly comprising: (a) an inlet having an open and closed position; (b) a waste collection member (c) a vacuum means for generating a flow of air from said inlet to said collection member; and (d) an electrical switch adapted to interact with the inlet, wherein the inlet when open activates the switch to allow/direct/receive waste/debris through the inlet and wherein the waste collection member comprises a plurality of open ends.

In another aspect, the invention provides a vacuum assembly for collecting debris comprising: (a) an inlet having an open and closed position; (b) a waste collection member (c) a vacuum means for generating a flow of air from said inlet to said collection member; and (d) an electrical switch adapted to interact with the inlet, wherein the inlet when open activates the switch to allow/direct/receive waste/debris through the inlet and wherein the waste collection member comprises a plurality of waste collection members.

In another aspect, the invention provides a vacuum assembly for collecting debris comprising: (a) an inlet having an open and closed position; (b) a waste collection member (c) a vacuum means for generating a flow of air from said inlet to said collection member; and (d) an electrical switch adapted to interact with the inlet, wherein the inlet when open activates the switch to allow/direct/receive waste/debris through the inlet and wherein the waste collection member comprises a plurality of open ends.

Preferably, the waste collection member comprises a plurality of open ends in the same collection member.

Preferably, the waste collection member comprises a plurality of open ends in different collection members.

Preferably, the collection member comprises two ends which are connected by a T-joint.

Preferably, one end of the T-joint is connected to a valve inlet and the other is connected to inlet A.

Preferably, the inlet comprises a spring loaded door.

Preferably, the door provides dual tension to hold the door in an open and a closed position.

In another aspect, the invention provides a vacuum assembly comprising: (a) an inlet A having an open and closed position; (b) a vacuum means for generating a flow of air from said inlet to said collection member; and (c) an electrical switch adapted to interact with the inlet, wherein the inlet when open activates the switch to allow/direct/receive waste/debris through the inlet.

Preferably, the inlet A comprises a spring loaded door.

Preferably, the door is flush mounted to an existing fitting.

Preferably, debris collects at a central location.

Preferably, the switch is an electrical switch.

Preferably, the switch is a micro switch.

Preferably, the rear portion of the Inlet A is adapted to fit into a wall cavity.

Preferably, the rear portion of the inlet A is adapted to receive an adapter having a smooth inner area which fits to a second adapter attached to a vacuum hose.

Preferably, the adapter is connected to a T-joint to allow fitting to multiple inlets A such as dustpans.

Preferably, the waste collection is located to receive debris in the vicinity of the inlet A such as a dustpan.

Preferably, the inlet or dustpan is activated by electromechanical means.

Preferably, the assembly may be turned on/off by a micro switch

BRIEF DESCRIPTION OF THE DRAWINGS

FIG. 1 shows as a preferred embodiment the KitVac® 6 installation method

FIG. 10 shows a simplified left view of the Dustpan, such that when the Flip Flop Door is open, the Low Voltage Switch is ON.

DETAILED DESCRIPTION OF THE INVENTION

The present invention relates to a vacuum assembly comprising: (a) an inlet A having an open and closed position; (b) a vacuum means for generating a flow of air from said inlet to said collection member; and (c) an electrical switch adapted to interact with the inlet, wherein the inlet when open activates the switch to allow/direct/receive waste/debris through the inlet.

In another aspect, the invention relates to a vacuum assembly comprising: (a) an inlet A having an open and closed position; (b) a vacuum means for generating a flow of air from said inlet to said collection member; and (c) an electrical switch adapted to interact with the inlet, wherein the inlet when open activates the switch to allow/direct/receive waste/debris through the inlet wherein the assembly is bagless.

In another aspect, the invention relates to a vacuum assembly, particularly comprising an innovative double inlet to collect debris direct and unrestricted into a novel double inlet dust bag increasing the efficiency of the unit by eliminating the need of fittings to branch-off.

The debris collector located at the floor level is novel device (Dustpan), the flip-flop door position is maintained by a single spring which secures the door on the open or close position and requires little force to operate and which can be initiated even by a bare footed youngster or elderly. The exposed area, the facia and flip-flop door are even and completely flat without noticeable protrusions, being a genuine flush mounted device, it can be installed completely safe in high traffic or visibility areas and will blend with any décor.

Thus, the present invention provides a vacuum assembly comprising a double inlet dust bag adapted to receive debris via an inlet positioned at the dust pan door adapted to form an open and a closed position.

Figures 1A, 1B:
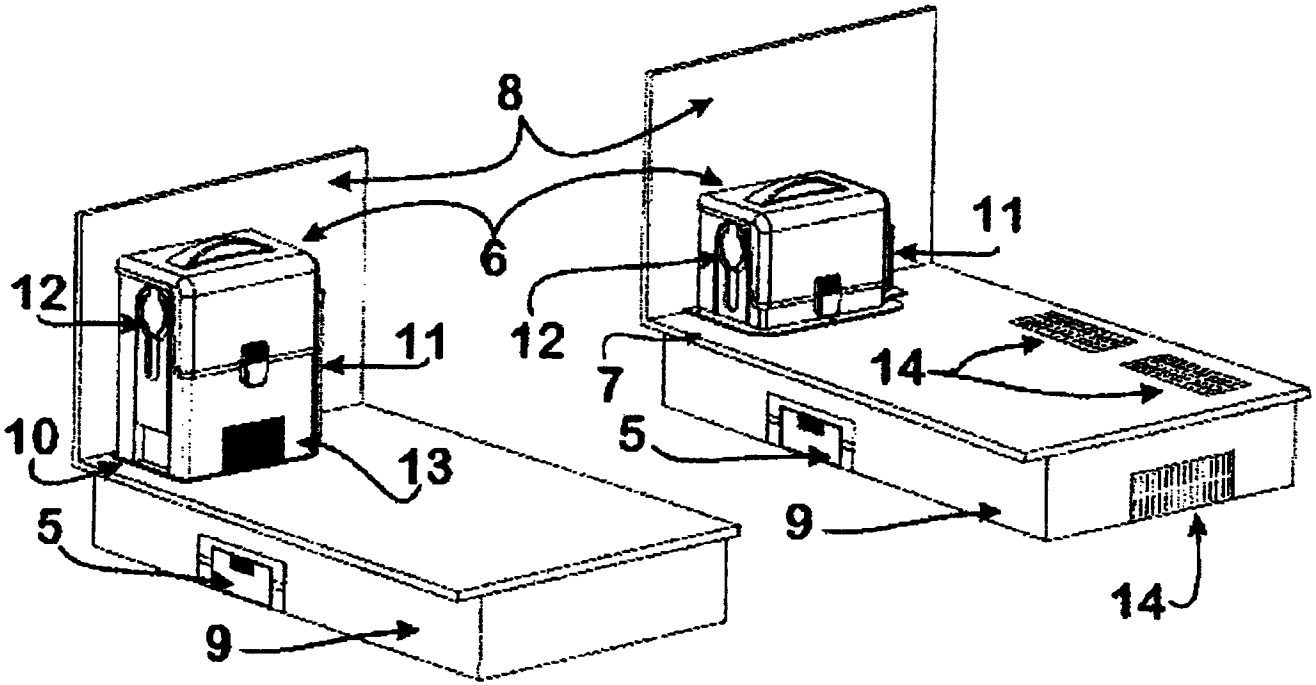
FIG. 1A shows a KitVac® 6 placed at the kickboard cavity's bottom through the cupboard bottom
FIG. 1B shows a KitVac® 6 installed in a cabinet.

FIG. 1 shows as an embodiment an installation method of a KitVac® 6 in a cabinet showing the KitVac® sitting directly on top of the cabinet bottom shelf 1A or cut into the kickboard 1B whereby part of the unit is hidden. The preferred embodiment outlines the two entries, the flush mounted dustpan 5 designed to collect debris from the floor, the dustpan rear entry 11 and the utility valve at front 12 is designed to house a vacuum hose. When mounted above the cabinet, the bottom 10 is visible and additionally when cut into the kickboard a trim 7 is an aesthetic addition to conceal the KitVac® assembly 6 cut out.

Figure 2:
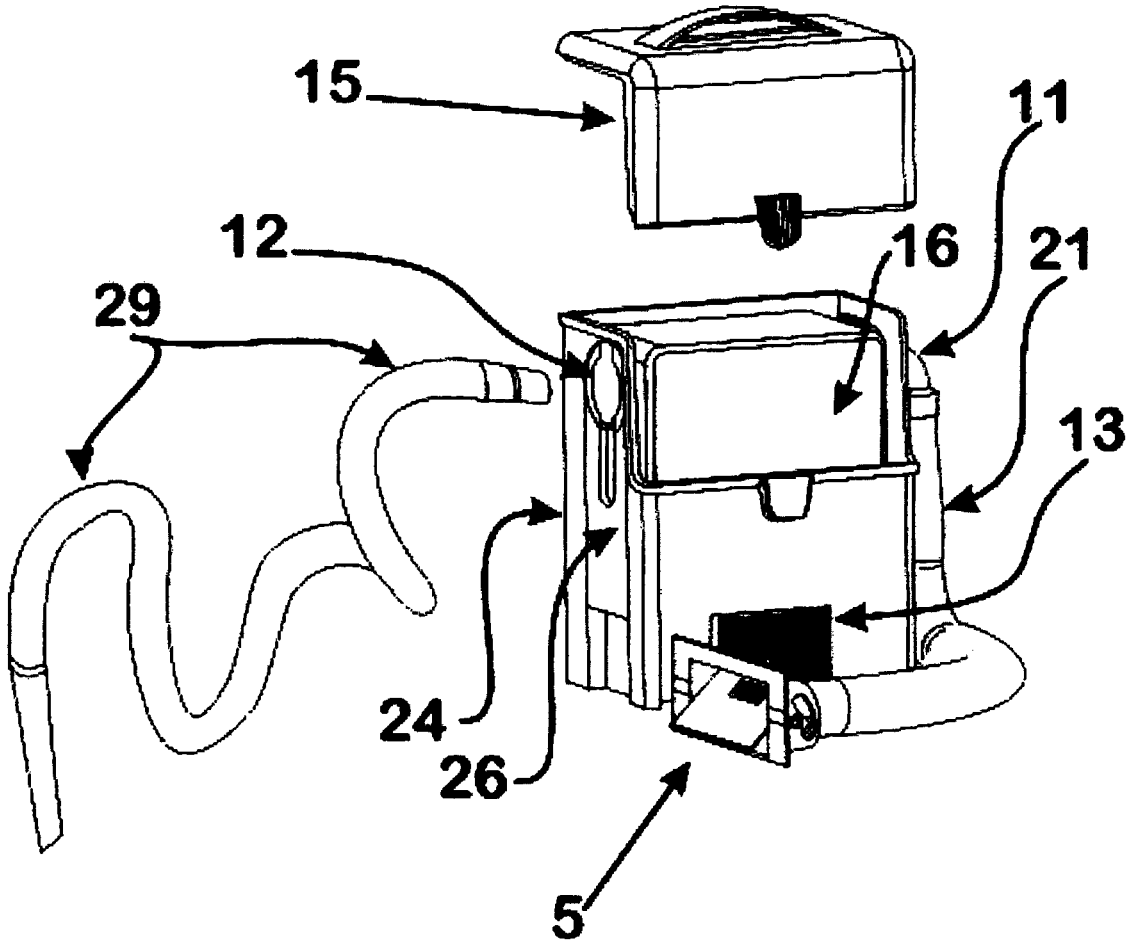
FIG. 2 shows the major components of KitVac®.

FIG. 2 shows some of the major components of KitVac®. The lid 15 is open to display the double entry dust bag 16. The utility valve 12 at the front joins the dust bag 16 and the vacuum hose 29. The dustpan assembly 5 is connected to the Dust Bag rear entry through the connection hose 21.

Figure 3:
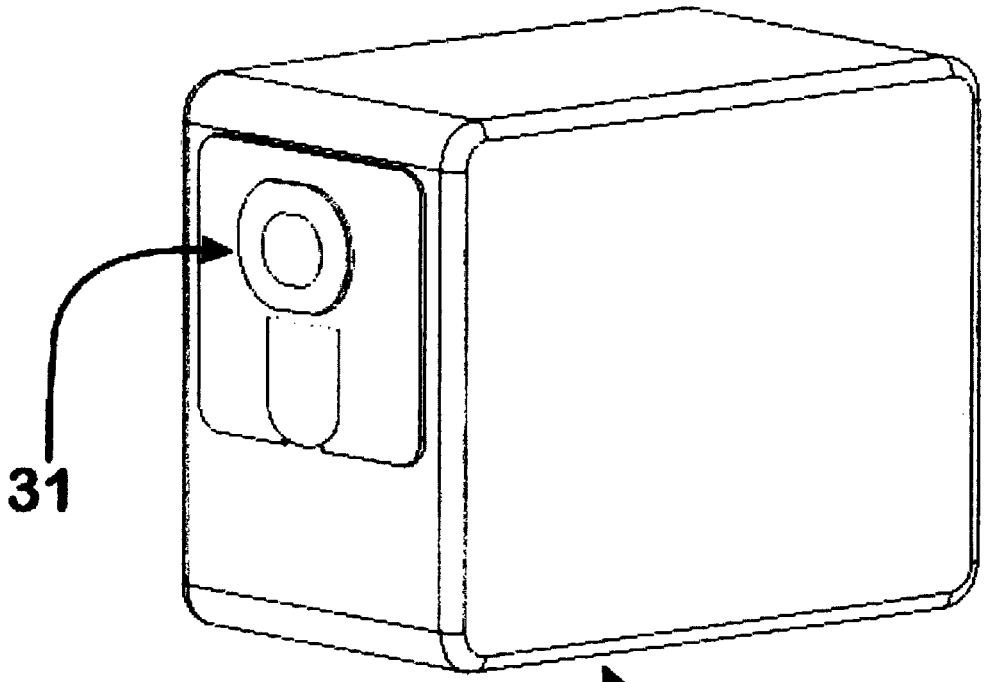
FIG. 3 shows the novel Dual Inlet Bag 16 left side entry 31.

FIG. 3 shows the novel dual inlet bag 16 left side entry 31.

Figure 4:
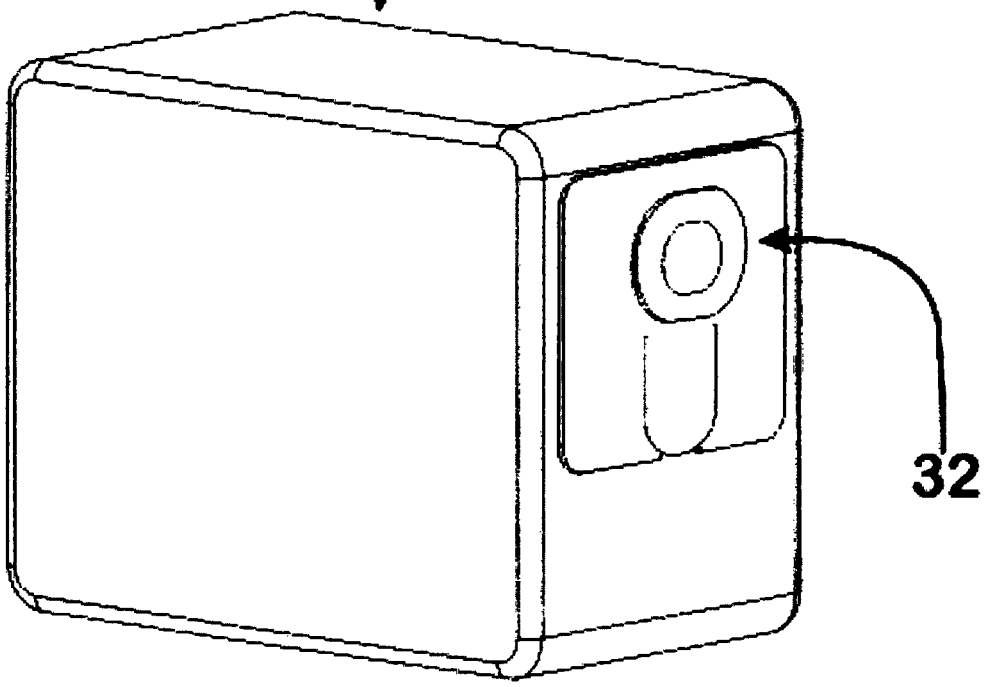
FIG. 4 shows the novel Dual Inlet Bag 16 right side entry 32.

FIG. 4 shows the novel dual inlet bag 16 right side entry 32.

Figure 5:
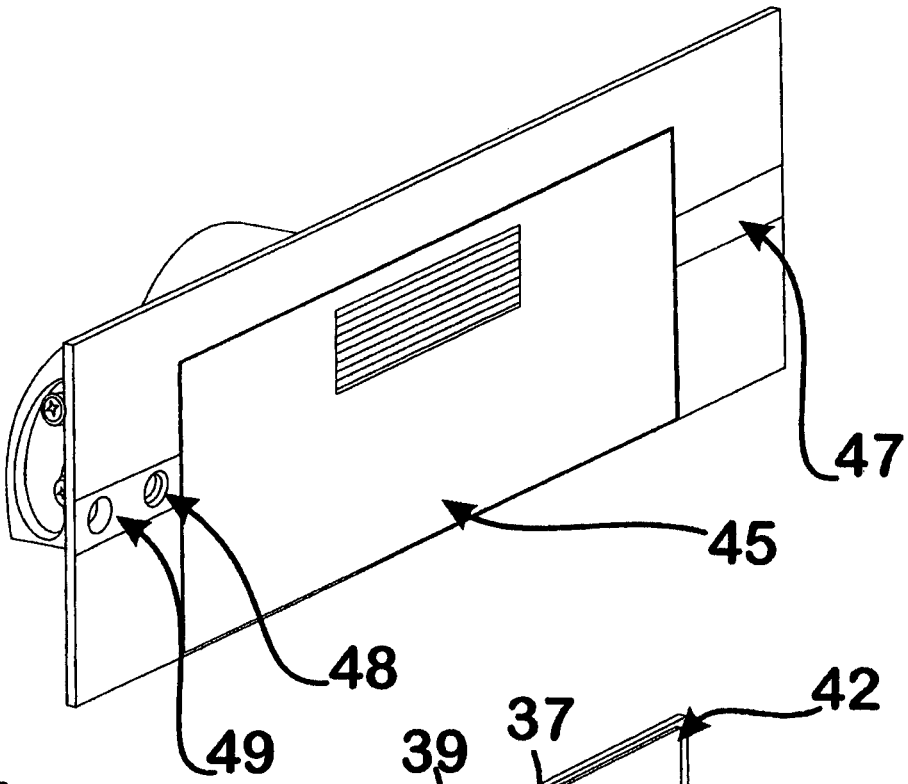
FIG. 5 shows the front view of Dust Pan Assembly 5.

FIG. 5 shows the dust pan assembly 5 front view, the flip flop door 45 in the closed or resting position. A rubber seal is attached at the rear of the door and seals against the dustpan inlets inside chamber. Hence, the fascia is completely flat. A dustpan screw cover 47 is removed to uncover the dust screw cover clip penetration 48 and the dustpan fixing screw penetration 49.

Figure 6:
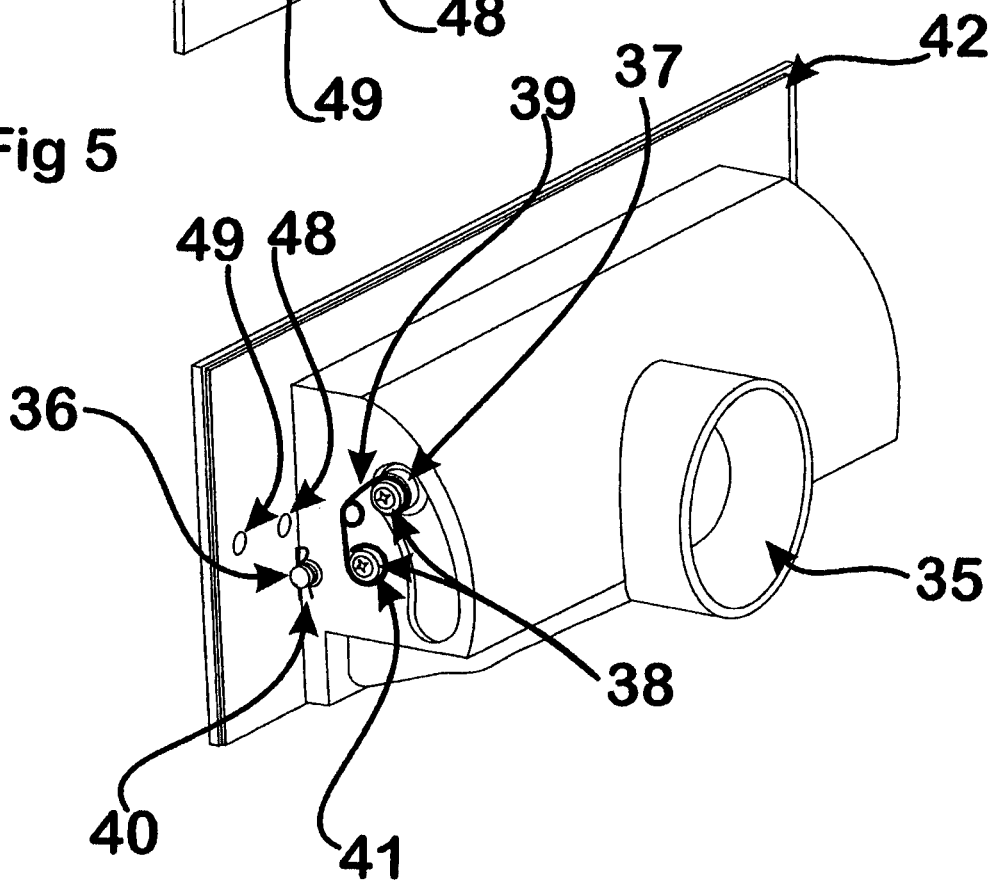
FIG. 6 shows the rear view and non contact switch side of Dust Pan Assembly 5.

FIG. 6 shows the dust pan assembly 5 rear view and outlines the dustpan assembly's outlet 35 which can be reduced in length to suit a narrow wall space. The solid flip flop door's pivoting shaft 36 is secured by a steel clip 40. The actuator spring 39 is mounted between the flip flop door's actuator spring housing 37 and the dustpan body's actuator spring housing 41 and secured in both ends by a retainer screw 38. The rebate 42 keeps the assembly secure with the penetration.

Figure 7:
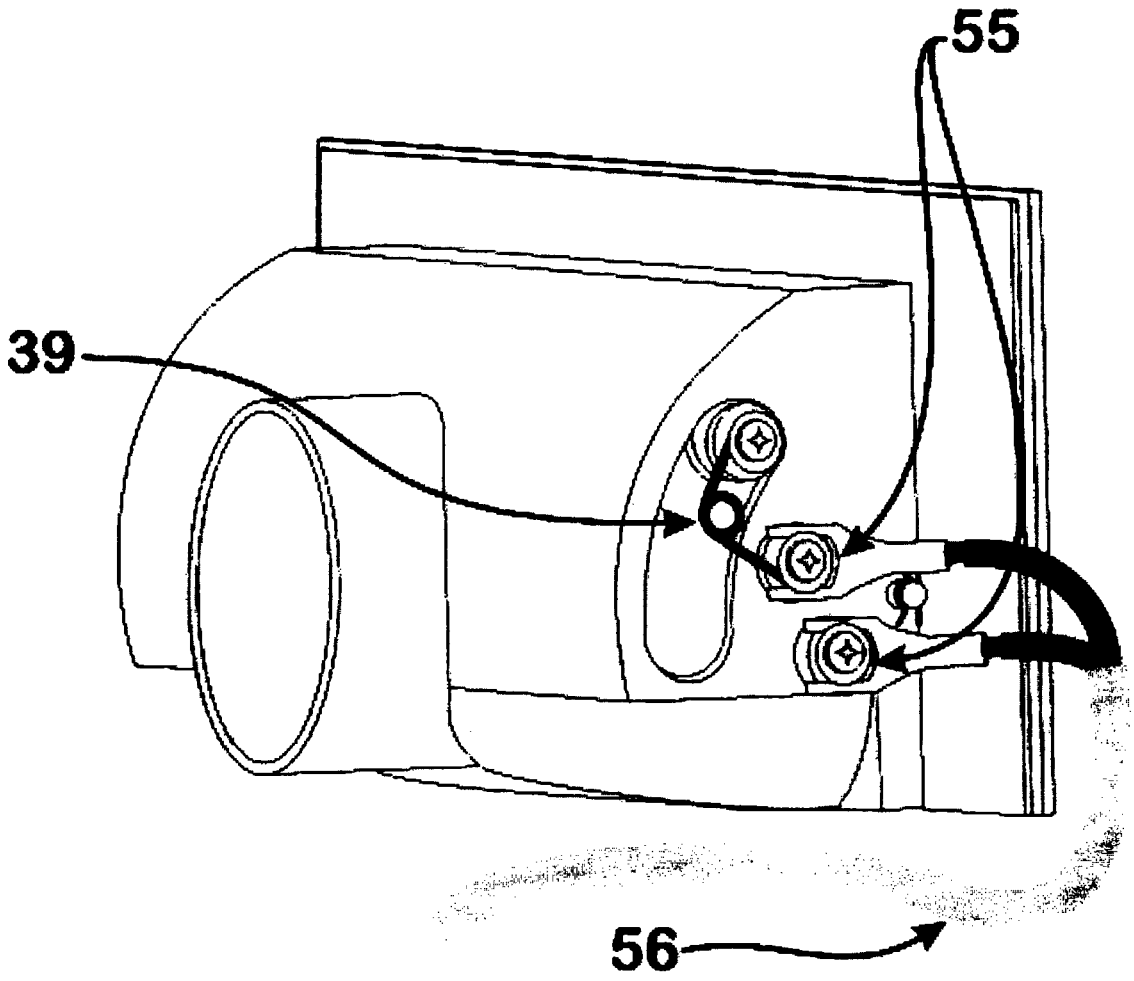
FIG. 7 shows the rear view and contact switch side of Dust Pan Assembly 5.

FIG. 7 shows the dust pan assembly 5 rear view and illustrates the details of the electrical connection of the low voltage switch 55, the actuator spring 39 in resting position. The low voltage switch 55 is open and the low voltage cable 56 takes the ON/OFF signal to the logic circuit. Both 55 & 39 are connected around metalized bosses to ensure a consistent electrical contact.

Figure 8:
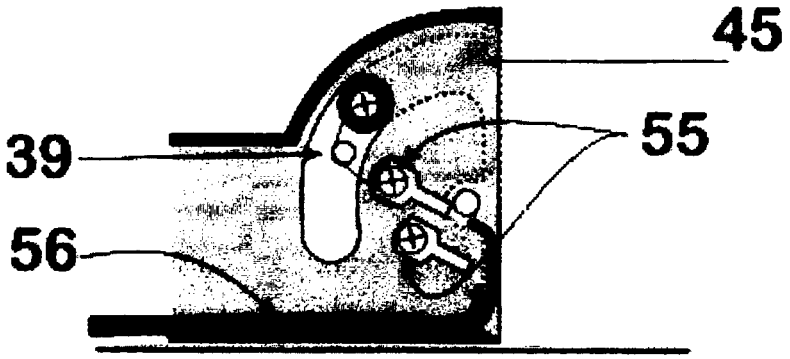
FIG. 8 shows a simplified left view of the Dustpan, such that when the Flip Flop Door is closed, the Low Voltage Switch is OFF.

FIG. 8 shows a simplified left view of the dustpan and illustrates the flip flop door 45 in the closed position, low voltage switch 55 open, and the actuator spring 39 provides a positive pressure to keep the flip flop door closed. The low voltage cable 57 has no signal for the logic circuit.

Figure 9:
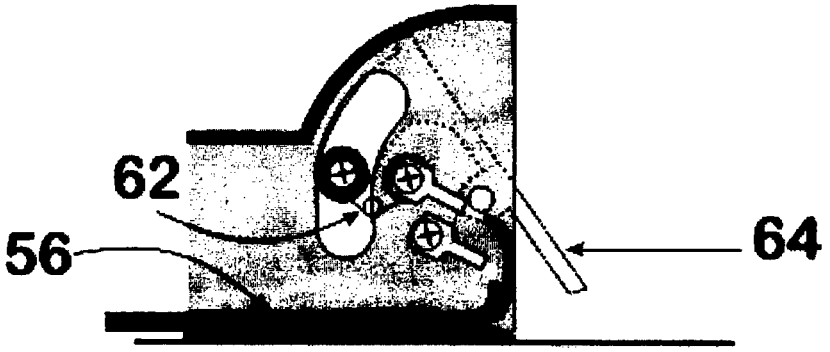
FIG. 9 shows a simplified left view of the Dustpan, such that when the Flip Flop. Door is half way, the Low Voltage Switch is OFF.

FIG. 9 shows a simplified left view of the dustpan and illustrates the flip flop door 64 in the half way position, low voltage switch 55 open, and the actuator spring 39 is compressed. The low voltage cable 57 has no signal for the logic circuit.

Figure 10:
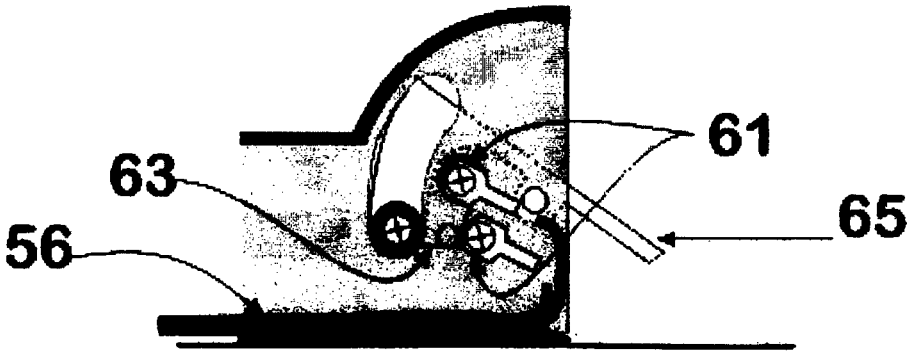

FIG. 10 shows a simplified left view of the dustpan and illustrates the flip flop Door 45 in the open position, low voltage switch 55 closed, and the actuator spring 39 provides a positive pressure to keep the flip flop door open. The low voltage cable 57 acts as a signal for the logic circuit to start the machine.

Figure 11:
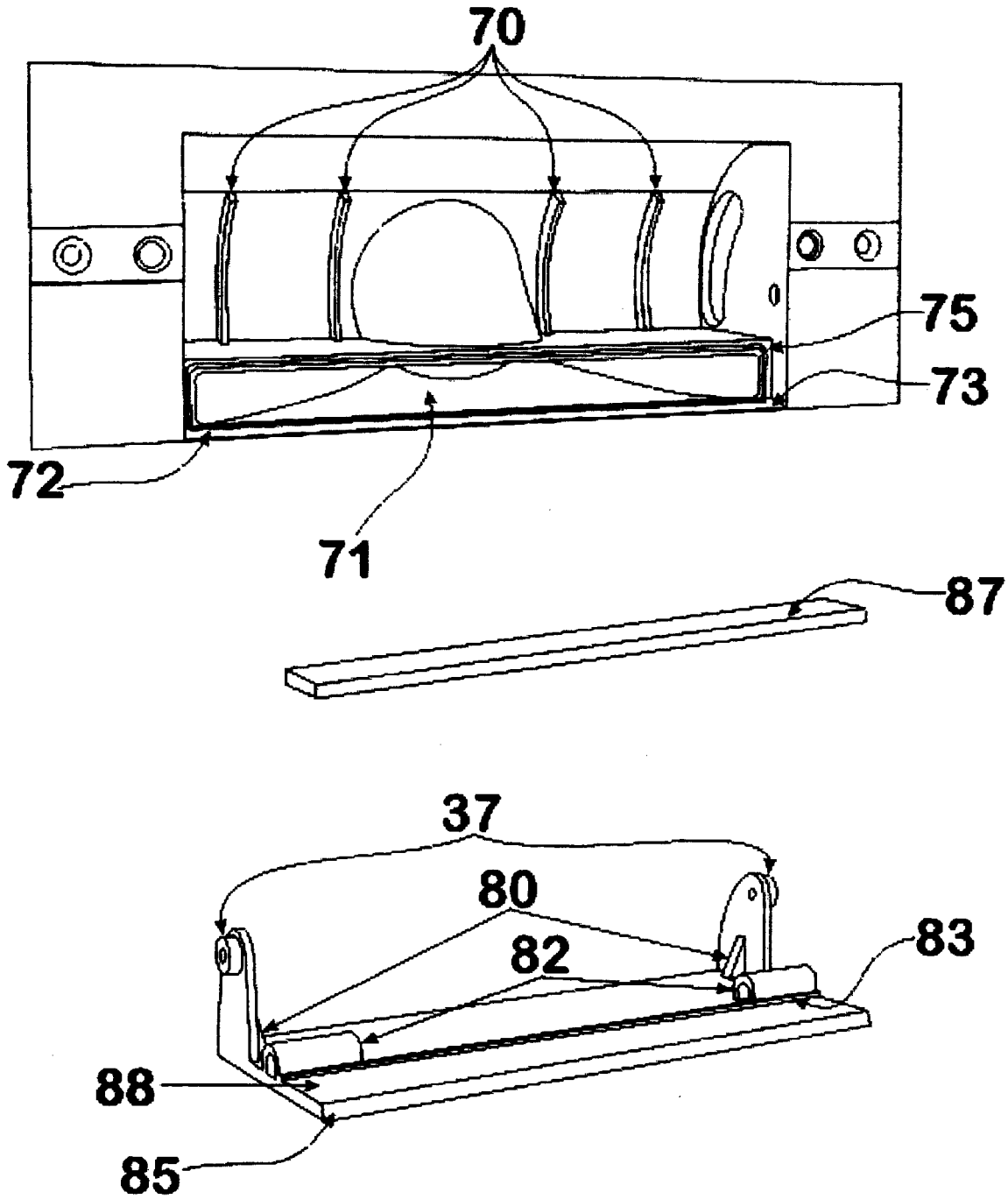
FIG. 11 shows a front of view of the dustpan body collection chamber, a view of the backside of the dustpan door and rubber seal.

FIG. 11 shows a front of view of the dustpan body collection chamber, a view of the backside of the dustpan door and rubber seal.

FIG. 11 shows a front view of the dustpan without the flip-flop door 45 and discloses the dirt collection chamber 71. The flip flop door movements are limited by the open door limiters 70 comprising four ribbings and the solid surface of the closed door limiters 75, protecting the flip-flop door against abuses at both ends. The flip flop door 45 is further strengthened by the door shaft sleeves 82 which house the long flip flop doors pivoting shaft 36 which is one long piece of solid steel protruding through the main body. The flip flop doors actuator spring housing 37 is strengthened by the base stiffeners 80. The dustpan dirt collection chamber 71 which also ends in a solid surface named the close door limiters 75 has a continuous lip seal 72 which provides a protruding even surface which will be imprinted in the soft rubber seal 87 producing a quality vacuum seal. The soft rubber seal 87 is placed against the rubber seal mounting guide 83 and fixes to the soft rubber seal area 88; the soft rubber seal 87 protrudes slightly over the chamfered bottom edge 85 producing an extra sealing area by taking the ramp bottom seal 73 sloped shapes.

The actual dirt collection chamber is all rounded and tapers towards the vacuum source/mouth opening and because this area is very close to the main air suction source and that the bottom lip is shallow, ensures that all debris (crumbs & dirt etc) are removed efficiently from the chamber.

The flip flop door 45 or Inlet A is conveniently designed to provide an aesthetic appearance to the surroundings. Preferably, the door 45 may be installed as a debris collector in an area constantly used in the house and which area collects debris or dust. The door 45 fits into any household fitting including kitchen cabinets, laundry, bathroom, breakfast bars and cabinet and the like. Preferably, the door 45 is flush mounted to an existing fitting such as a kitchen cabinet kickboard and positioned only a few centimeters from the floor. The door 45 is composed of material suitable for such purposes including stainless steel, metal or metal compositions, plastic, laminate and the like.

Preferably, the door 45 represents a door having an open and a close orientation. Application of a slight pressure by foot, for example, enables the door 45 to be pushed inwardly thereby activating an electrical switch which in turn provides power to the vacuum system. Upon activation of the switch 45 and supply of power to the vacuum assembly, debris or dust is sucked into the open door 45 and into the waste collector or dust bag 16 by force of the air supply through the vacuum assembly. The activation system of the invention provides special convenience to users by reason of the fact that it may be foot activated. Upon opening of the door, the vacuuming action of the vacuum collecting system is automatically initiated by means of a door-activated switch associated with such door which sends an electric signal to activate the vacuum suction source "on" when the door is opened. Closure of the door shuts the vacuum source "off".

In one embodiment, the inlet door 45 operates as a dustpan, designed as a slim flush mounting, protruding only about 3.6 mm from the face of the face of a kitchen kickboard. The swinging motion of the door, providing an open and a closed position, promotes simplicity of operation of the vacuum system. The door is spring loaded providing dual tension which allows the door to be held in an open and a closed position. The dual tension property is achieved by spring placement. The spring is anchored to the dustpan body and the dustpan door. The spring is nailed to the anchorage point on the dustpan door and moves through an arc with a stationary centre point as the door swings open and closed. The spring pivots around the anchorage point on the dustpan body which remains stationary. The distance between the moveable anchorage point on the dustpan door and the stationary centre point of the arc is greater than the distance between the anchorage point on the dustpan door and the stationary anchorage point on the dustpan door. This arrangement provides maximum tension when the door is approximately mid way between the open and closed positions.

Preferably, the vacuum assembly of the present invention may be located at floor level, preferably installed beneath an existing household fixture, such as a kitchen counter.

The vacuum assembly comprises a waste collector that may be elevated above the plane of the floor to provide space for a vacuum conduit coupling located on its lower side. A conduit coupling is preferably also provided on the upper side of the receptacle. Further multiple vacuum outlets may also be included by installing an enlarged assembly.

In one application of the invention, the vacuum cleaning suction source is located at a fixed, central place within the building housing the system such as a garage. In another application of the invention, the vacuum suction source may be provided by a portable vacuum cleaner that is stored in a location, such as inside a kitchen cupboard, where it is electrically and pneumatically coupled to provide the vacuum suction according to the present invention.

In another embodiment, the present invention provides a valve inlet or a utility inlet that enables the vacuum assembly to be used as a central vacuum system.

In another embodiment, the present invention relates to a switch which activates the door in the open and closed positions. Preferably the switch is manually operated. In another embodiment, the switch is electromechanically operated. In another embodiment the switch is a micro switch.

In another aspect, the invention provides a stopper to prevent abuse or accidental operation of the vacuum system.

The present invention related to the KitVac® may be installed in dwellings such as homes, boats, motor homes, mobile homes and the like. The KitVac assembly may also be installed in the commercial market such as commercial buildings, offices, shops, businesses, food mall, etc.

In another embodiment, the KitVac® may be designed to operate as a portable unit.

As used herein, the term "flush mounted" refers to the face or surface of a unit, such as a dustpan according to the present invention, being substantially flat or square faced with an existing fitting such that there is no protruding member.

One of the major advantages of having a flush mounted dustpan according to the present invention is that there is less likelihood of the vacuum assembly being activated accidentally. Furthermore, even if the face of the dustpan is kicked in slightly, the door comprises members such as close door limiters to ensure that the door needs to retract sufficiently before the switch becomes activated to send an electric signal to the vacuum system to start.

The present invention of the KitVac® relies on easier installation, efficiency and aesthetic qualities of the assembly. That is to provide a unit/s (still capable of servicing the whole house), but allows users to easily (DIY) install KitVac® s dust collectors at the floor level in common use areas (mainly kitchens and bathrooms, but not limited to these areas), whereby a larger percentage of time, traffic and mess is generated in around these hubs plus the facility of dust collectors in flexible hose as well.

In some dwellings, the assembly may be designed such that the rear portion of the Inlet A such as a dustpan is adapted to fit into a wall cavity. In use, the rear portion of the dustpan is indented to allow the dustpan to fit into a wall cavity.

Different fittings or connections could be utilized at the rear of the assembly when in use. The KitVac® dustpan could be used on its own by connecting a smooth adaptor or by using existing piping arrangements.

Hence the connection at the rear of the assembly may be via use of a smooth adaptor(s) or traditional 2" inch current ducted vacuum fittings.

The rear portion of the inlet A is adapted to receive an adapter having a smooth inner area which fits to a second adapter attached to a vacuum hose. The smooth inner area is necessary to ensure that dirt or debris does not collect around the adapter opening and thereby decrease efficiency of the assembly.

The adapter may be connected to a T-joint to allow fitting to multiple inlets such as dustpans. This arrangement would enable the dustpans to be located at different locations in a dwelling including the kitchen, hallway, family areas and bathroom.

In one embodiment, the waste collection member is located to receive debris in the vicinity of the dustpan.

In one embodiment, the KitVac® machine or assembly may be turned on/off by a micro switch. The micro switch may be located on the dustpan or inlet, or alternatively at a remote location such as on a bench top in the kitchen.

In another embodiment, the inlet or dustpan may be activated by electro mechanical means. Hence the dustpan door may be opened or closed by means such as a solenoid, for example.

Description of the KitVac® Kit:

a) The KitVac® Unit is designed to sit on the bottom cupboard shelf or rest in the kickboard cavity floor protruding thought cabinet floor, fixed to any cupboard wall with two screws located at the bag compartment.
b) The KitVac® can also be free standing but needs to be secured to a wall.
c) The KitVac® can be mounted against any cupboard walls. The components are exchangeable, whilst always having the utility valve that houses the flexible hose and dust collector at the front of the machine.
d) The KitVac® provides the following features:
   - Double entry Dust Bag which allows the usage of two intakes without the need of "T" joints increasing the suction efficiency to the maximum.
   - Flush mounted dust collector/s at the floor level making possible to install them in high traffic or visibility areas.
   - The floor Dust Collector is designed to be operated with a minimum of force; the Flip-Flop Door requires a very weak inward push at the top thus a bear footed infant or elderly can use.
   - The hot exhaust air is directional and can be re-directed towards an opening or other cupboard vent/s keeping the machine cool and efficient.
e) The KitVac® lid is designed to uncover the top and the front, thus allowing for easier access to exchange the bag.
f) The rear side entry of the assembly is connected to the Dustpan comprising standard fittings, allowing the installation of extra Dustpans or wall inlet Valves.

The KitVac® Dustpan:

1. The assembly provides a flush mount dustpan receptacle that has a square face with no protrusions.
2. The new dustpan does not protrude any more than the thickness of the material (Only 3.6 mm). The door lines up flush with the main chamber collection receptacle.

3. The square face with no protrusions eliminates knocking (which can cause injury), damage and failure to the collection receptacle itself and or unnecessary turning on of the machine by accidentally knocking the switch (protruding lever).
4. The new receptacle does not require a separate lever/component (be it protruding or not) to activate the switch. It uses the door to activate the switch to both the on/off position. The door actually opens/turns inside the collection chamber.
5. In using the door as your switch significantly increases the switch turn on/off area. This provides the end user with a far greater width and ease of opening, as opposed to needing to exactly locate a smaller on/off switch mechanism.
6. Both the opening and closing is aided with a spring mechanism which allows the user to open the door at the far sides or centre of a wider area.
7. The end result provides a far more simplified and easier opening/closing. Push in (ON), push back is (OFF). And most importantly, can be operated by the user wearing any footwear or with no footwear and now becomes a far safer product that can be installed in high traffic areas or places that users stand around quite frequently.
8. Spring mechanism also applies pressure to both the closed (better vacuum seal) and open position (therefore, when the door is open, you can knock it etc, but ultimately to close the door, you need to apply specific pressure to turn off).
9. Plastic ribbing inside the collection chamber protects door opening i.e. the door is stopped by the ribbing.
10. Specially designed caps have been incorporated to hide the screws keeping in line with the overall slim like flush non obtrusive appearance.
11. The new main body collection receptacle has a rebate at the back, so that a stainless steel trim can be fitted over the body without any fixings. Additionally the door can be fitted with a stainless steel trim. Thus any cabinet maker or handyman can build the assembly. Due to its square faced build, the user can select the same Laminex colour as used throughout their building and apply it to the KitVac® dustpan. Again this selection is only possible due to the square faced front which provides an aesthetic appearance and flush finish.
12. The rear protrusion male outlet is preferably the standard female coupling fittings. This then allows it to be reduced in size by any installer should they want to use special female couplings that are smaller in length.
13. The dustpan has been built and designed to take any abuse or accidental misuse both when opening the dustpan door and pushing/kicking from the bottom will meet with a firm resistance and will not cause any damage and when opening and one trying to keep pushing the door in will again meet with a firm resistance in the way of 4 stoppers/ribs.
14. The rubber seal integrity is further increased by not only sealing shut at the back of the rubber (when sealing the dustpan bottom collection chamber), but also get further assistance via the springs and the rubber seal at the bottom also seals against the bottom chamber giving a greater surface area of seal.

Preferably, two collection/depositing systems feed into the one collection chamber in a bag vacuum system.

Numerous vacuum bag designs providing a selection of varying degree of shape, size and materials are available in the market. However, they do all have one thing in common. That is, a single entry point system for dirt collection to be contained inside the collection bag, unlike the dust bag of the present invention which comprises two ends in the one bag.

In another embodiment, the invention provides an assembly according to the present invention using a bagless unit.

Main Advantages of the Dual Bag Collection System:

1. Allows connections from two separate lines, of which one can be optionally connected directly into the KitVac® and the other line can run another inlet or multiple inlets via the other connection source.
2. Allows the user to have a utility outlet right at the front of the KitVac®, which is fitted directly into the machine, into the bag compartment and without any airflow restrictions or having to pipe into the main line and use extra fittings (such as a tee piece) which creates an unnecessary eye sore.
3. Provides the vacuum unit with a far greater degree of flexibility and options in mounting.
4. Allows the user to be able to run two separate lines from different directions, but only has to empty one larger collection bag.
5. Optionally by running two separate lines into the dirt collection chamber, the user could still use two single collection bags for each end, within the one collection chamber.
6. Reduces air losses by providing an air tight seal around the fixtures of the assembly.

KITVAC DESCRIPTIONS

FIG. 1
5 Dustpan Assembly
6 KitVac Assembly
7 Kickboard Cavity
8 Cabinet or Cupboard
9 Kickboard
10 Base
11 Dustpan Rear Entry
12 Utility Valve Front Entry
13 Directional air discharge vent
14 Cabinet vents
FIG. 2
15 KitVac Lid
16 Dual Inlet Bag
21 connection hose
24 main body
26 Cables Cover
29 Vacuum Hose
FIGS. 3 & 4
31 Dual Inlet Valve Left Side Entry
32 Dual Inlet Bag Right Side Entry
FIG. 6
35 Dustpan Assembly's Outlet
36 Flip Flop Door's Pivoting Shaft
37 Flip Flop Door's Actuator Spring Housing
38 Retainer Screws
39 Actuator Spring
40 Steel Clip
41 Dustpan Body's Actuator Spring Housing
42 Rebate
FIG. 5
45 Flip Flop Door
47 Dustpan Screw Cover
48 Cover Clip Penetration
49 Dustpan fixing Screw Penetration
FIG. 7
55 Low Voltage Switch Open Position
56 Low Voltage Flexible Cable

FIGS. 8, 9 & 10

60

61 Low Voltage switch, closed position

62 Actuator Spring Compressed

63 Actuator Spring Maintain the door Open and bridge the Low Voltage Switch

64 Flip Flop Door Halfway Position

65 Flip Flop Door Open Position

FIG. 11

70 Open Door Limiters (Ribbings)

71 Dirt Collection Chamber

72 Continuous Lip Seal

73 Ramp Bottom Seal

75 Close Door Limiter (Solid Surface)

80 Base Stiffener

82 Door Shaft Sleeves

83 Rubber Seal Mounting Guide

85 Chamfered Bottom Edge

87 Soft Rubber Seal

88 Soft Rubber Seal Area

While considerable emphasis has been placed herein on the specific features of the preferred embodiment, it will be appreciated that many additional features can be added and that many changes can be made in the preferred embodiment without departing from the principles of the invention. These and other changes in the preferred embodiment of the invention will be apparent to those skilled in the art from the disclosure herein, whereby it is to be distinctly understood that the foregoing descriptive matter is to be interpreted merely as illustrative of the invention and not as a limitation.

The claims defining the invention are as follows:

1. A vacuum assembly comprising: (a) an inlet A having an open and closed position; (b) a vacuum waste collection member; (c) a vacuum means for generating a flow of air from said inlet to said collection member; and (d) a switch adapted to interact with the inlet, wherein the inlet when open activates the switch to receive debris through the inlet and the inlet A is flush mounted, wherein the vacuum waste collection member comprises a plurality of open holes and the inlet comprises a flush mounted spring loaded door.

2. The assembly according to claim 1 wherein the inlet is opened by pushing the inlet inwardly by application of slight pressure.

3. The assembly according to claim 2 wherein the pressure is applied by pushing or pressing a foot against the inlet wherein the switch operates in an OFF position when the door is closed and ON position when slight pressure is applied to the inlet.

4. The assembly according to claim 1 wherein the vacuum collection member comprises two receiving holes wherein the receiving holes form in opposite ends of the same collector.

5. The assembly according to claim 1 wherein the vacuum collection member comprises two receiving holes wherein the two receiving holes form in different collectors.

6. The vacuum assembly according to claim 1 wherein the inlet is flush mounted to an existing fitting wherein the inlet is flush mounted to a kitchen cabinet kickboard, bathroom, a breakfast bar, a laundry wall, or is wall mounted substantially perpendicular to a bench top.

7. The assembly according to claim 1 comprising an inlet valve adapted to receive a vacuum hose fitting.

8. The vacuum assembly according to claim 1 wherein the collection member comprises two ends which are connected by a T-joint.

9. The vacuum assembly according to claim 8 wherein one end of the T-joint is connected to a valve inlet and the other is connected to inlet A.

10. The assembly according to claim 1 wherein the door provides dual tension to hold the door in an open and a closed position.

11. The assembly according to claim 1 wherein the waste collection is located to receive debris in the vicinity of the inlet A, wherein the inlet A comprises a dustpan.

12. A vacuum assembly comprising: (a) an inlet A having an open and closed position; (b) a waste collection member; (c) a vacuum means for generating a flow of air from said inlet to said collection member; and (d) a switch adapted to interact with the inlet, wherein the inlet when open activates the switch to receive debris through the inlet and the inlet A comprises a dual tension spring loaded door wherein the door is flush mounted.

13. The assembly according to claim 12 wherein the door is flush mounted to an existing fitting.

14. The assembly according to claim 12 wherein the rear portion of the inlet A is adapted to fit into a wall cavity.

15. The assembly according to claim 12 wherein the rear portion of the inlet A is adapted to receive an adapter having a smooth inner area which fits to a second adapter attached to a vacuum hose.

16. The assembly according to claim 15 wherein the adapter is connected to a T-joint to allow fitting to multiple inlets A, wherein said multiple inlets A comprise dustpans.

17. A vacuum assembly comprising: (a) an inlet A having an open and closed position; (b) a vacuum waste collection member; (c) a vacuum means for generating a flow of air from said inlet to said collection member; and (d) a switch adapted to interact with the inlet, wherein the inlet when open activates the switch to receive debris through the inlet and the inlet A is flush mounted, wherein the vacuum waste collection member comprises two receiving holes wherein the two receiving holes form in different collectors and wherein the inlet is opened by pushing the inlet inwardly by application of slight pressure.

* * * * *